US005104594A

United States Patent [19]

Hillemeier et al.

[11] Patent Number: 5,104,594

[45] Date of Patent: Apr. 14, 1992

[54] DRYING THE SURFACE OF A FRESH CONCRETE BODY

[75] Inventors: Bernd Hillemeier, Wiesbaden; Claus Flohrer, Neu-Isenburg; Andreas Schaab, Elsenfeld, all of Fed. Rep. of Germany

[73] Assignee: Hochtief Aktiengesellschaft Vorm. Gebr. Helfmann, Essen, Fed. Rep. of Germany

[21] Appl. No.: 467,610

[22] Filed: Jan. 19, 1990

[30] Foreign Application Priority Data

Feb. 2, 1989 [DE] Fed. Rep. of Germany ..... 3902995

[51] Int. Cl.[5] ..... B29C 71/02; B29C 71/04; F26B 3/347; H05B 6/02

[52] U.S. Cl. ..... 264/25; 34/9; 34/17; 34/39; 34/95; 34/DIG. 1; 219/6.5; 219/10.41; 219/10.57; 219/10.65; 219/10.79; 264/344; 264/345; 264/DIG. 43; 264/DIG. 46; 404/77; 404/79

[58] Field of Search ..... 264/344, 340, 345, 234, 264/DIG. 43, DIG. 46, 25-27, 347; 34/9, 95, 17, 39, DIG. 1; 404/77, 79, 72; 219/10.41, 10.57, 10.65, 10.79, 6.5

[56] References Cited

U.S. PATENT DOCUMENTS

| | | | |
|---|---|---|---|
| Re. 29,517 | 1/1978 | Becker | 52/172 X |
| 1,656,387 | 1/1928 | Nelson | 264/344 |
| 1,768,366 | 6/1930 | McKeeson | 264/79 |
| 1,808,762 | 6/1931 | Brund et al. | 264/DIG. 46 X |
| 1,841,928 | 1/1932 | Anderson | 264/31 |
| 1,942,000 | 1/1934 | Reynolds | 404/72 X |
| 1,999,152 | 4/1935 | Finley | 264/79 |
| 2,393,541 | 1/1946 | Kohler | 264/25 |
| 2,683,916 | 7/1954 | Kelly | 264/DIG. 46 X |
| 2,841,856 | 7/1958 | Gelbman | 264/DIG. 46 X |
| 2,971,239 | 2/1961 | Schaich | 264/DIG. 46 X |
| 3,192,291 | 6/1965 | D'Onofrio | 264/DIG. 46 X |
| 3,659,785 | 5/1972 | Nelson et al. | 239/2.1 |
| 3,727,982 | 4/1973 | Itoh et al. | 219/10.57 X |
| 3,755,915 | 9/1973 | Nagell | 34/95 |
| 3,872,196 | 3/1975 | Bridgeford | 264/344 X |
| 4,109,033 | 8/1978 | Blankenhorn et al. | 404/79 X |
| 4,254,559 | 3/1981 | Purinton, Jr. | 34/9 |
| 4,305,681 | 12/1981 | Backlund | 404/79 X |
| 4,309,610 | 1/1982 | Hillemeier | 250/342 |
| 4,383,376 | 5/1983 | Numamoto et al. | 34/95 X |
| 4,423,694 | 1/1984 | Senneville | 264/31 X |
| 4,453,320 | 6/1984 | Zimmermann et al. | 34/95 |
| 4,460,524 | 7/1984 | Takahashi et al. | 267/27 X |
| 4,588,505 | 5/1986 | Walley et al. | 34/95 |
| 4,819,342 | 4/1989 | Matsubara et al. | 34/95 |
| 4,843,730 | 7/1989 | Grant et al. | 34/95 X |

FOREIGN PATENT DOCUMENTS

| | | | |
|---|---|---|---|
| 3018043 | 11/1981 | Fed. Rep. of Germany | 404/79 |
| 1271503 | 10/1989 | Japan | 404/79 |

*Primary Examiner*—Karen Aftergut
*Attorney, Agent, or Firm*—Herbert Dubno; Andrew Wilford

[57] ABSTRACT

A surface of a fresh concrete body is dried by first covering the surface to be dried with a layer of bibulous granules having a great internal surface area for a time sufficient to draw generally all of the water out of the body via the surface and then preventing water from entering the layer from its side turned away from the body. The granules are finely divided hygroscopic particles, with an internal surface area of at least 200 $m^2/g$, preferably at least 800 $m^2/g$. The hydrophilic particles take up the moisture from the concrete and hold it in the layer of particles lying on the surface. This reduces the partial vapor pressure on the surface of the concrete body which effectively draws further liquid out of the concrete. The particles are a mixture of a cross-linked polymer that only swells in water and silica. The particles are carried in a coherent mat and are applied as a layer to the surface by laying the mat thereon. This mat has a moisture-pervious face and a moisture-impervious face so that water is prevented from entering the layer from the side turned away from the body by orienting the moisture-impervious face away from the body. The moisture-impervious face is formed by a synthetic-resin sheet.

9 Claims, 1 Drawing Sheet

DRYING THE SURFACE OF A FRESH CONCRETE BODY

FIELD OF THE INVENTION

The present invention relates to a method of and system for drying the surface of a fresh concrete body. More particularly this invention concerns the curing of slabs used in repairing a road or bridge.

BACKGROUND OF THE INVENTION

In the preparation of concrete bodies, particular slabs for road or bridge repair, the surface of the fresh concrete is first cleared of the aqueous solution/suspension (hereinafter referred to as "water") arising from the concrete. Then further water is drawn from the capillaries of the porous body to maximize its hardness. As much of this water as possible is drawn off, but under any circumstances more is likely to diffuse into surface layers from more deeply within the body. Whether the concrete in question is of standard mix or of the new synthetic-resin colloidal types, it is normally desired to reduce the moisture content to less than 5% of the mass of the body. This is fairly difficult to do, especially outside where humid surroundings can impede drying of the body, or where in fact the body might be rained on or subject to other wet climatic action. Capillary action from dew or rainfall alone can draw considerable moisture relatively deep into a fresh concrete body.

When excessive moisture is left in the concrete body, bubbles can form, even in relatively moisture-tolerant resin mixes. In situations where the body must be bonded to an existing body, as in a repair job, the resultant bond can be weak, leading to early separation of the new from the old.

The standard method of drying a fresh concrete body, that is one that was recently placed or poured and that has not fully cured, is by the simple application of heat to its upper surface. Heating the surface of the body produces a vapor-pressure gradient from the outside of the body inward, with the dew point being further inward when the surface is hot. Thus as the body cools, the dew point moves outward so that in effect moisture is caused to diffuse from the interior toward the surface of the body. Added to this effect is the moisture supplied by the surroundings in the form of humid air, precipitation, dew, or the like, and the fresh concrete can quickly take on an unacceptable amount of water. Putting a vapor barrier on the surface, typically a plastic sheet, merely drives back water rising to the surface of the concrete.

OBJECTS OF THE INVENTION

It is therefore an object of the present invention to provide an improved drying system for fresh concrete.

Another object is the provision of such an improved drying system for fresh concrete which overcomes the above-given disadvantages, that is which ensures that the body is thoroughly dried even when it might be exposed to very wet conditions.

SUMMARY OF THE INVENTION

A method of drying a surface of a fresh concrete body according to this invention comprises first covering the surface to be dried with a layer of bibulous granules having a great internal surface area for a time sufficient to draw generally all of the water out of the body via the surface and preventing water from entering the layer from its side turned away from the body. The granules according to this invention are finely divided hygroscopic particles, with an internal surface area of at least 200 $m^2/g$, preferably at least 800 $m^2/g$.

With this procedure the hydrophilic particles take up the moisture from the concrete and hold it in the layer of particles lying on the surface. This reduces the partial vapor pressure on the surface of the concrete body which effectively draws further liquid out of the concrete. The result is an intensive drying effect. At the same time the layer is prevented from taking up water from the surroundings by being protected on its side turned away from the concrete body it is drying, typically by the provision of a cover foil glued atop the layer which itself is carried in some sort of matrix like a fibrous fleece.

In accordance with further features of this invention the particles are of silica, typically made by precipitation or by high-temperature hydrolysis. More particularly, the particles are a mixture of silica with a cross-linked polymer that only swells in water, that does not dissolve. This polymer is acrylic acid, methacrylic acid, acrylic amide, methacrylic amide, methacrylic nitrile, or mixtures thereof. The particles can also be of calcium chloride, zeolite, silica gel, or mixtures thereof. Although it is within the scope of this invention to strew these particles on the surface and cover them with an impervious foil or the like, in a preferred embodiment the particles are carried in a coherent mat and are applied as a layer to the surface by laying the mat thereon. This mat has a normally downwardly oriented moisture-pervious face and an opposite moisture-impervious face so that water is prevented from entering the layer from the side turned away from the body by orienting the moisture-impervious face away from the body. The moisture-impervious face is formed by a synthetic-resin sheet.

According to another feature of this invention the body includes ferrous reinforcement which is heated to further increase the drying effect. The reinforcement is heated inductively so that the body is heated from the inside out, eliminating the above-mentioned wicking effect caused by heating from the outside in. The inductive heater can be the standard coil arrangement used to heat reinforcement rods so they can be found by taking a thermogram of the body.

The drying system according to this invention therefore comprises a mat having a pair of opposite faces one of which is moisture pervious, a mass of bibulous particles dispersed throughout the mat, and a moisture-impervious sheet covering the other mat face. Thus, when the mat is laid on the surface with the pervious face down, moisture from the body is taken up by the particles. The mat is left in place until the desired dryness is obtained, or is removed and replaced when it becomes saturated. Once wet, the mat can be restored by intensive heating to dry out its particle filling.

DESCRIPTION OF THE DRAWING

The above and other objects, features, and advantages will become more readily apparent from the following, reference being made to the accompanying drawing in which.

SPECIFIC DESCRIPTION

Figure 1:
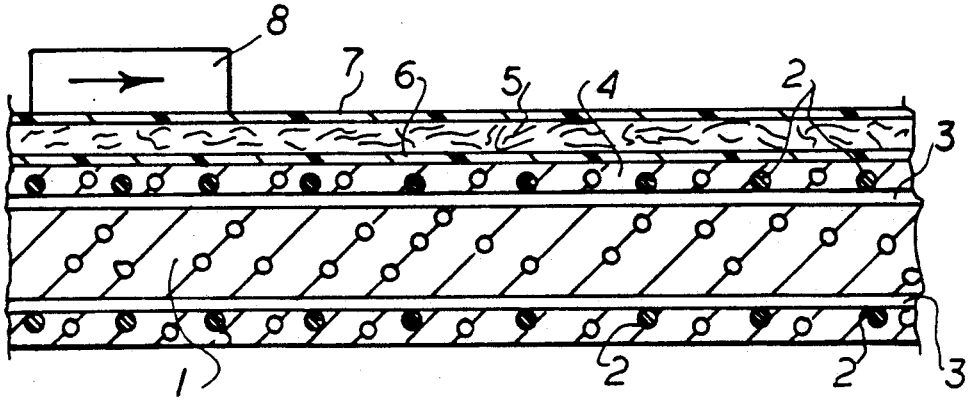
FIG. 1 is a vertical section through a reinforced-concrete slab being dried according to this invention.
Figure 2:
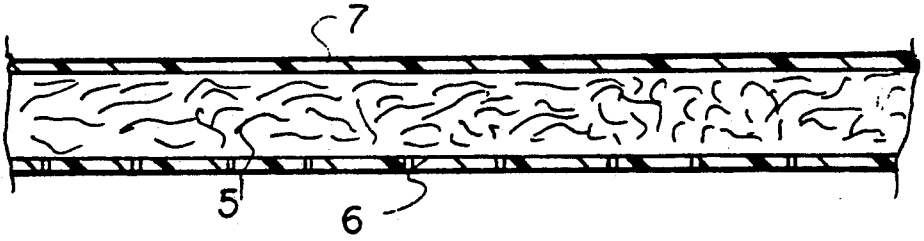
FIG. 2 is a large-scale cross section through the drying mat according to the invention.

As seen in FIG. 1 a concrete body 1 is provided with steel-bar longitudinal reinforcements 2 and transverse reinforcements 3. An upper surface region 4 of this body 1 is dried by laying on it a mat formed of a core 5 comprised of a fleece of synthetic-resin fibers in which are dispersed hydrophilic finely divided particles sandwiched between a lower face sheet 6 that is moisture pervious and an upper face sheet 7 that is moisture impervious. Both sheets 6 and 7 are made of a synthetic-resin, but the sheet 6 is perforated or otherwise made porous.

This mat 5, 6, 7 is laid on the body 1 after the surface water has been driven therefrom by compressed air or the like. Water is drawn through the sheet 6 into the particle-carrying fleece 5. Even if it rains on the outside layer 7, this added liquid will not saturate the middle layer 5. Sealing around the edges is normally not needed, although it is completely possible to have the layer 7 extend past the layers 5 and 6 all around and to weight it down or bond it to the body 1 to prevent moisture entry into the edge of the core layer 5.

Once the fleece 5 is saturated, the mat can be removed and, if necessary, replaced by another. A dryer can be used to restore the wet mat to reusable condition To this end the mat is made flexible so it can be easily rolled up and folded, although it is within the scope of this invention to make the mat a stiff panel.

In order to enhance the drying effect, an inductive coil unit such as shown schematically at 8 is passed over the body 1, atop the mat 5, 6, 7. This unit 8, which can be of the type used to heat reinforcements so they can be found by infrared detection, heats the reinforcement 2, 3 to drive moisture out of the center of the body 1. The electromagnetic field passes through the mat 5, 6, 7 and the concrete body 1 with no problem, heating only the reinforcement 2, 3. This creates a vapor-pressure gradient from the reinforcement 2, 3 to the outside of the body 1. Such a procedure greatly enhances the drying effect.

We claim:

1. A method of drying a surface of a fresh concrete body having a center portion into which body is incorporated ferrous reinforcement, the method comprising the steps of covering the surface to be dried with a coherent mat in which are dispersed bibulous granules having a great internal surface area, the mat having a pair of opposite faces one of which is impervious to liquid water and the other of which is pervious to liquid water;

orienting the mat on the surface with the water-pervious face lying against the surface and the water-impervious face turned upward to prevent water from entering the mat except through the water-pervious face;

leaving the mat on the surface for a time sufficient to draw generally all of the water out of the concrete body via the surface and through the water-pervious face of the mat; and inductively heating the ferrous reinforcement and thereby also heating the body from within and driving the water from the center portion of the body, to thereby enhance the drying of the surface of the body.

2. The drying method defined in claim 1 wherein the water-impervious face is formed of a synthetic-resin sheet.

3. The drying method defined in claim 1 wherein the granules are finely divided hygroscopic particles.

4. The drying method defined in claim 3 wherein the internal surface area is at least 200 $m^2/g$.

5. The drying method defined in claim 3 wherein the internal surface area is at least 800 $m^2/g$.

6. The drying method defined in claim 3 wherein the particles are of silica.

7. The drying method defined in claim 3 wherein the particles are a mixture of a cross-linked polymer that only swells in water and silica.

8. The drying method defined in claim 7 wherein the polymer is acrylic acid, methacrylic acid, acrylic amide, methacrylic amide, methacrylic nitrile, or mixtures thereof.

9. The drying method defined in claim 3 wherein the particles are of calcium chloride, zeolite, silica gel, or mixtures thereof.

* * * * *